United States Patent [19]

Jean et al.

[11] 4,258,228

[45] Mar. 24, 1981

[54] ELECTRICAL INSULATOR HAVING CLAMPING JAWS WITH SEPARATELY FABRICATED LINER MEMBERS

[75] Inventors: Leonard P. Jean, Nashua; Ernest J. La Chance, Sr., Milford, both of N.H.

[73] Assignee: Hendrix Wire & Cable Corp., Milford, N.H.

[21] Appl. No.: 65,216

[22] Filed: Aug. 9, 1979

[51] Int. Cl.[3] ..... H01B 17/22

[52] U.S. Cl. ..... 174/168; 24/262

[58] Field of Search ..... 174/155, 156, 157, 168, 174/181, 207, 208, 209; 24/262

[56] References Cited

U.S. PATENT DOCUMENTS

| | | | |
|---|---|---|---|
| 527,317 | 10/1894 | Bullock | 174/209 X |
| 805,169 | 11/1905 | Taubold | 174/155 |
| 854,315 | 5/1907 | Stauffer | 174/155 |
| 1,896,921 | 2/1933 | Smith | 174/155 X |
| 2,647,943 | 8/1953 | Kreisler | 174/207 |
| 3,235,652 | 2/1966 | Lindsey | 174/168 X |

FOREIGN PATENT DOCUMENTS

| | | | |
|---|---|---|---|
| 22746 | 2/1936 | Australia | 174/168 |

*Primary Examiner*—Laramie E. Askin

*Attorney, Agent, or Firm*—Thompson, Birch, Gauthier & Samuels

[57] ABSTRACT

An electrical insulator having opposed jaws with at least one of the jaws being adjustable in relation to the other jaw for clamping an electrical conductor therebetween. The jaws are part of plastic pieces which are molded at elevated temperatures and which undergo thermal contraction when cooled subsequent to the molding process. Opposed grooves are provided in the confronting surfaces of the jaws. Liner members consisting of a material different from that of the jaws are received in the grooves. The liner members are sized for ready insertion into the grooves while the interior groove dimensions are expanded as a result of the elevated molding temperatures. The subsequent thermal contraction of the internal groove dimensions during cooling results in the liner members being firmly anchored within the grooves.

10 Claims, 7 Drawing Figures

ELECTRICAL INSULATOR HAVING CLAMPING JAWS WITH SEPARATELY FABRICATED LINER MEMBERS

BACKGROUND OF THE INVENTION

This invention relates in general to plastic insulators for clamping or holding electrical conductors above the ground for aerial power distribution and transmission. Preferred examples of such insulators are described in U.S. Pat. No. 4,134,574 and U.S. Pat. application Ser. No. 830,671, now U.S. Pat. No. 4,178,470, both patents having been assigned to the assignee of this invention.

Such insulators have opposed jaws, with at least one jaw being adjustable relative to the other jaw for clamping an electrical conductor therebetween. The jaws are molded from a plastic such as polyethylene.

It has now been determined that in order to improve the adaptability of such insulators for use with either bare conductors or conductors covered with insulation, it would be desirable to provide the confronting jaw surfaces with liner members specifically designed for each conductor type. In this manner, the major portion of the insulator can be standardized to accept different types of liner members. The liner members must, however, be securely anchored to the jaws by a means which does not in any way compromise other desirable characteristics of the insulator, such as economy of manufacture, low dielectric constant and resistance to weather and tracking.

BRIEF SUMMARY OF THE INVENTION

The present invention achieves the foregoing objectives by providing opposed grooves in the confronting surfaces of the molded plastic insulator jaws. Liner members consisting of a material which is different from that of the insulator jaws and which is selected to suit a particular type of conductor, are received in the aforesaid grooves. The liner members are sized for insertion into the grooves while the interior groove dimensions are expanded as a result of the elevated molding temperatures. Subsequent thermal contraction of the internal groove dimensions during post molding cooling results in the liner members being firmly anchored in the grooves. This anchoring is accomplished without having to resort to additional fastening means, such as pins, screws or the like, which would increase the overall cost of the unit, while possibly also adversely affecting the insulator's insulating capacity.

Typically, the insulator body and its associated jaw members may be molded from polyethylene, whereas the liner members can consist of a wide variety of different materials, for example glass-filled nylon for use with conductors covered with insulation, and an aluminum alloy for bare conductors.

Preferably, the jaw grooves are provided with opposed tapered interior sides which cooperate with oppositely facing tapered exterior sides on the liner members to provide a dovetail interlock as the jaws undergo thermal contraction. The liner members are preferably additionally provided with ears at their opposite ends which overlap the jaw sides to further enhance the aforesaid interlocked relationship.

The frontal clamping surfaces of the liner members can be designed to suit differing requirements, depending on the type of conductor involved. For example, when clamping bare conductors, the frontal clamping surfaces of the liner members are preferably made flat and smooth so as to prevent conductor damage while still providing a high friction surface. On the other hand, when clamping a conductor covered with insulation, the frontal clamping surfaces of the liner members are preferably provided with ribs to indent into the surface of the cable insulation, thereby providing a substantial holding capacity for longitudinal loading. Such ribs may preferably be crossed at 45° angles to prevent a covered conductor from rotational movement as well as longitudinal movement.

These and other objects and advantages of the present invention will become apparent to those skilled in the art from the following detailed description taken in conjunction with the accompanying drawings.

DETAILED DESCRIPTION OF INVENTION

Figure 1:
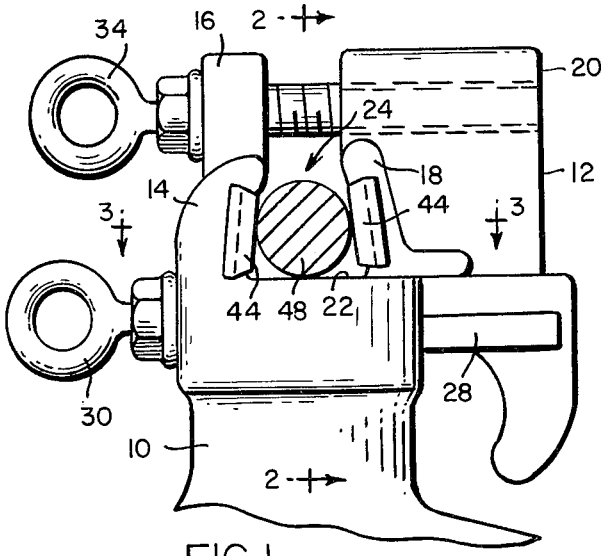
FIG. 1 is a side elevational view of a plastic insulator embodying the concepts of the present invention, with a bare conductor gripped between cast aluminum alloy insert members.
Figure 2:
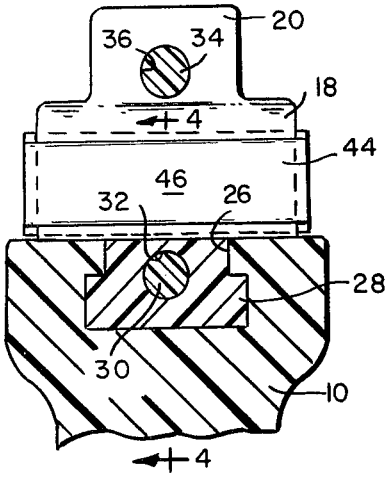
FIG. 2 is a vertical sectional view taken on line 2—2 of FIG. 1.

Referring initially to FIGS. 1 and 2, an insulator is shown comprising a main body 10 and a slide member 12, both being separately molded at elevated temperatures from a suitable plastic material such as polyethylene. The main body 10 has a jaw 14 capped by an upstanding boss 16. The slide member 12 has a jaw 18 and a somewhat larger upstanding boss 20. The jaws 14, 18 confront one another and cooperate with a horizontal surface 22 on the body 10 to define a clamping notch 24.

Body 10 is transversely grooved as at 26 to slidably receive an elongated foot 28 on the slide member 12. A torque bolt 30 extends freely through a hole (not shown) in body 10 and is threaded into an aligned hole 32 in the foot 28. Another torque bolt 34 extends freely through the hole (not shown) in boss 16 and is threaded into an aligned hole 36 in boss 20. Rotation of the bolts 30, 34 will result in movement of the slide member 12 relative to the main body 10, with a corresponding adjustment of the space between jaws 14, 18. The bolts 30, 34 can be molded from any suitable high strength non-metallic material, for example glass filled nylon.

Figure 3:
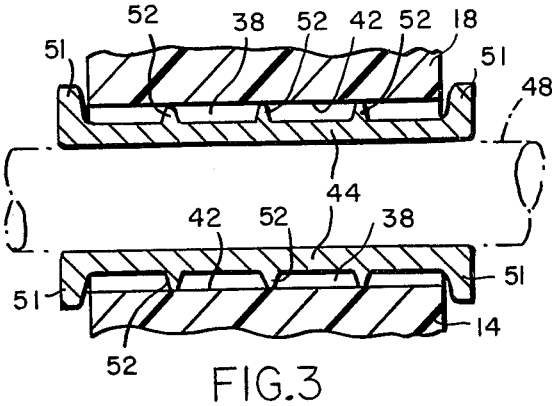
FIG. 3 is a horizontal sectional view taken on line 3—3 of FIG. 1.
Figure 4:
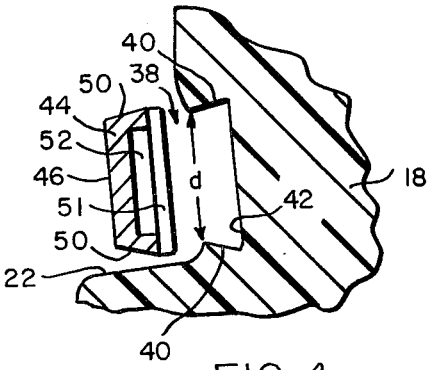
FIG. 4 is a sectional view taken along line 4—4 of FIG. 2 showing the liner member prior to its insertion in the jaw groove.

Referring additionally to FIGS. 3 and 4, it will be seen that both jaws 14 and 18 are provided with grooves 38 extending longitudinally from side to side across their respective confronting surfaces. The grooves 38 each have inwardly tapered sides 40 extending forwardly from the groove bottoms 42.

In the arrangement shown in FIGS. 1–4, liner members 44 are adapted to be received in the grooves 38. The liner members 44 are cast from an aluminum alloy or other suitable metal. Aluminum alloy liners work well with bare conductors because when they are in solid contact with the bare conductor surface, they assume full line voltage and provide high metal-to-metal friction for holding capacity.

The liner members 44 have relatively smooth, flat frontal clamping surfaces 46 which coact in frictional engagement with a bare conductor 48 extending longitudinally through the clamping notch 24 and supported on the horizontal surface 22. Each liner member 44 has outwardly tapered sides 50 extending rearwardly from its frontal clamping surfaces 46. Each liner member 44 is further provided at its opposite ends with rearwardly protruding ears 51.

Immediately after the molding operation of the main body 10 and the slide member 12 and while the temperature of these components is still relatively high, the dimension "d" (see FIG. 4) of their respective grooves 38 is expanded sufficiently to receive a separately fabricated liner member 44. When thus received in the grooves 38, the ears 51 of the liner members overlap the sides of the jaws 14, 18, and rearwardly protruding ribs 52 on the back surfaces of the liner members engage the groove bottoms 42. Then, as the molded components 10, 12 cool, the internal dimensions of the grooves 38 undergo thermal contraction, thus bringing the tapered groove sides 40 into firm engagement in a dovetail interlocked relationship with the tapered sides 50 on the liner members. As a result, the liner members 44 are firmly anchored in the grooves 38, without having to resort to additional fastening elements such as screws, pins or the like.

In use, as shown in FIGS. 1 and 3, the insulator supports a bare conductor 48 on the surface 22 within the clamping notch 24. The bolts 30, 34 are tightened to close the gap between the jaws 14, 18 sufficiently to firmly clamp the cable between the frontal clamping surfaces 46 of the liner members 44. The overlap of the ears 51 on the jaw sides prevents the liner members from shifting longitudinally as the cable 48 undergoes longitudinal loading. The rearwardly protruding ribs 52 provide longitudinal holding capacity in addition to the end ears 51.

Figure 5:
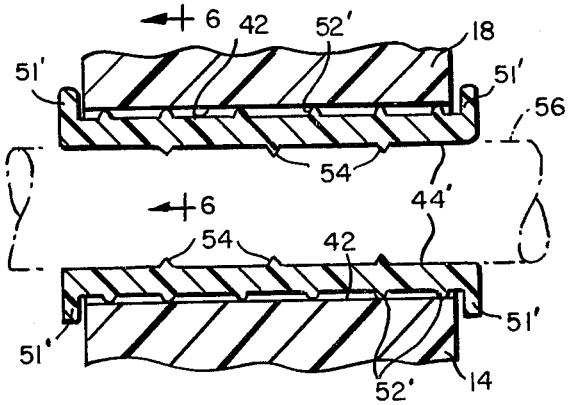
FIG. 5 is a view similar to FIG. 3 showing an insulated conductor gripped between glass-filled nylon liner members.
Figure 6:
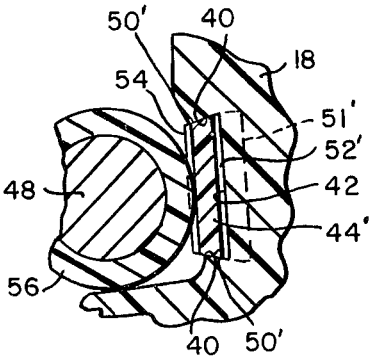
FIG. 6 is a sectional view taken along line 6—6 of FIG. 5.
Figure 7:
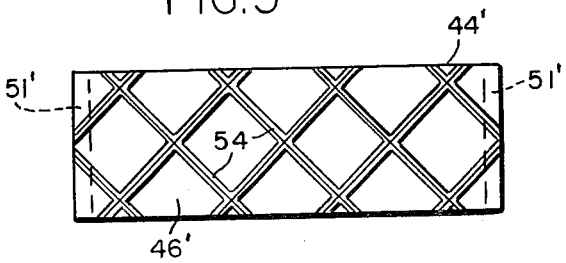
FIG. 7 is a front elevational view of an insert member of the type shown in FIGS. 5 and 6.

The liner members 44' shown in FIGS. 5–7 are similar in overall design to the liner members 44, in that they too are provided with frontal clamping surfaces 46', tapered sides 50', rearwardly protruding ribs 52' and end ears 51'. The liner members 44' are dimensioned for insertion into and subsequent retention in the grooves 38 in the same manner as the liner members 44. However, the liner members 44' differ from liner members 44 in that the former are molded of a non-metallic material, a preferred example of which is glass-filled nylon. Also, the frontal clamping surfaces 46' are provided with raised gripping ribs 54 which, as shown in FIG. 7, are preferably crossed at 45° angles. The liner members 44' are non-metallic so as not to interfere with the insulating capacity of the cable insulation. The clamping ribs 54 indent into the surface of the cable insulation 56. This positive interlock provides a substantial holding capacity for longitudinal loading. The 45° crossing of the ribs 54 prevents rotational movement of the covered conductor after it has been clamped in the notch 24.

We claim:

1. In an electrical insulator having opposed jaws, at least one jaw being adjustable in relation to the other jaw for clamping an electrical conductor therebetween, the said jaws consisting of plastic pieces which are molded at elevated temperatures and which undergo thermal contraction when cooled subsequent to the molding process, the improvement comprising: opposed grooves in the confronting surfaces of said jaws; and, liner members consisting of a material different from that of said jaws, said liner members being inserted into said grooves while the interior groove dimensions are expanded as a result of the elevated molding temperatures, with the subsequent thermal contraction of the internal groove dimensions during cooling resulting in said liner members being firmly anchored within said grooves.

2. The insulator of claim 1, wherein said jaws are molded from polyethylene, and wherein the material of said liner members is glass-filled nylon.

3. The insulator of claim 1, wherein said jaws are molded from polyethylene, and wherein the material of said liner members is an aluminum alloy.

4. The insulator of claim 1, 2 or 3 wherein opposed interior sides of said grooves and oppositely facing exterior sides of said liners are arranged to provide a dovetail interlock as said jaws undergo thermal contraction.

5. The insulator of claim 1 wherein said grooves extend longitudinally from side to side across the confronting surfaces of said jaws, said grooves having inwardly tapered sides extending forwardly from the bottoms thereof, said liner members extending longitudinally in said grooves and having frontal clamping surfaces with outwardly tapered sides extending rearwardly from said frontal clamping surfaces to back surfaces, the outwardly tapered sides and back surfaces of said liners being arranged to be firmly engaged respectively by the inwardly tapered sides and bottoms of said grooves during thermal contraction of said plastic pieces.

6. The insulator of claim 5 further comprising ears on the ends of said liner members arranged to overlap the sides of said jaws.

7. The insulator of claim 5 wherein said liner members are cast from an aluminum alloy, and wherein said frontal clamping surfaces are relatively smooth and flat.

8. The insulator of claim 5 wherein said liner members are molded from glass-filled nylon, and wherein said frontal clamping surfaces are provided with raised gripping ribs.

9. The insulator of claim 8 wherein said raised gripping ribs are crossed at 45° angles.

10. The insulator of claim 5 wherein the back surfaces of said liner members are provided with raised ribs arranged to engage the bottoms of said grooves.

* * * * *